US005375692A

United States Patent [19]

Staudinger et al.

[11] Patent Number: 5,375,692

[45] Date of Patent: Dec. 27, 1994

[54] SEPARATION AND TRANSFER METHOD AND APPARATUS

[75] Inventors: Reimar Staudinger, Minden; Gunter Geldmeier, Stemwede; Wilfried Muller, Rahden, all of Germany

[73] Assignee: Kolbus GmbH & Co., KG, Rahden, Germany

[21] Appl. No.: 75,299

[22] Filed: Jun. 11, 1993

[30] Foreign Application Priority Data

Jun. 19, 1992 [DE] Germany ..... 4219982

[51] Int. Cl.[5] ..... B65G 47/31

[52] U.S. Cl. ..... 198/461; 198/624

[58] Field of Search ..... 198/419.2, 460, 461, 198/608, 624

[56] References Cited

U.S. PATENT DOCUMENTS

| | | | |
|---|---|---|---|
| 2,580,469 | 1/1952 | Schwartz | 198/624 X |
| 3,827,545 | 8/1974 | Buhayar | 198/461 |
| 3,830,358 | 8/1974 | DeSantis | 198/461 X |
| 4,569,514 | 2/1986 | Holtje | 198/624 X |
| 4,724,946 | 2/1988 | Cinotti | 198/460 X |
| 5,088,590 | 2/1992 | Marschke | 198/461 |

FOREIGN PATENT DOCUMENTS

| | | | |
|---|---|---|---|
| 0201720 | 9/1987 | Japan | 198/461 |
| 0733375 | 7/1955 | United Kingdom | 198/461 |

*Primary Examiner*—James R. Bidwell
*Attorney, Agent, or Firm*—Chilton, Alix & Van Kirk

[57] ABSTRACT

A transfer device for books, inner books, newspapers, stacks or papers or similar products that are fed to a distribution point in a product stream on a high speed conveyor which includes a rotationally driven accelerator/decelerator. The speed of the accelerator/decelerator is controlled in such a manner that the product to be distributed is first accelerated to separate it from the next succeeding product in the product stream and the product is then controllably slowed so that it may be stopped at the distribution point without damage.

17 Claims, 1 Drawing Sheet

SEPARATION AND TRANSFER METHOD AND APPARATUS

BACKGROUND OF THE INVENTION

1. Field of the Invention

The present invention relates to the creation of a spatial separation between individual, closely-spaced products moving on a high-speed conveyor and particularly to the interception and acceleration of such products followed immediately by the deceleration of the products in order to ensure against the impact thereof against a fixed stop at a downstream distribution point with sufficient force to cause damage to the products. More specifically, this invention is directed to apparatus for transferring books, book blocks, newspapers, stacks of folded or unfolded sheets of printed matter and other similar products from a high-speed conveyor to a distribution point and especially to transfer apparatus which creates a space between serially received incoming products while at the same time ensuring that the motion of the products is controllably retarded in the interest of gentle treatment. Accordingly, the general objects of the present invention are to provide novel and improved methods and apparatus of such character.

2. Description of the Prior Art

While not limited thereto in its utility, the present invention is particularly well suited for use in association with a book binding machine. Finished or partially finished products discharged from a book binding machine, such as books, inner books, newspapers, stacks of sheets, or the like, are typically stacked for further processing. These products are customarily of rectangular shape and will serially exit the book-binding machine positioned in close proximity to one another on a high-speed conveyor. The conveyor delivers the products to a distribution point where vertical stacking in a hopper or on an elevator-type mechanism will be accomplished or where the products are otherwise individually handled and their direction of motion changed. In the case of vertical stacking, the desired vertical orientation is, in part, achieved through causing the in-coming products to contact a stop which arrests the motion thereof. Because of the speed at which the products move on the conveyor, particularly in the case of a book-binding machine which operates at a high production rate, it is in practice difficult to obtain the desired vertical alignment. Also, as a consequence of the momentum which the products acquire, damage may occur as a result of the impact against the stop.

Published German Patent Application 39 38 536 discloses apparatus for forming a stack of folded sheets, the folded sheets standing on edge. This prior art apparatus employs braking rollers disposed between a delivery conveyor and a table on which the sheets are stacked. The braking rollers of the apparatus shown in the published German application are driven at a relatively low rotational speed, i.e., at a speed which is less than that of the delivery conveyor, and thus transfer the in-coming folded sheets to the table at a reduced forward speed. In theory, the braking rollers prevent any rebound or jolting of the folded sheets. In order for the apparatus of the published German application to function properly, a relatively large space must be provided between the individual folded sheets which are serially ejected from the upstream folding machine. If a sufficiently large separation is not maintained, sheets moving on the delivery conveyor may run up onto adjacent, leading sheets and proper stacking will not occur, i.e., the apparatus of German Application 39 38 536 does not have the capability of creating a separation between folded sheets when such separation does not exist.

SUMMARY OF THE INVENTION

The present invention overcomes the above-briefly discussed and other deficiencies and disadvantages of the prior art and, in so doing, provides an novel technique which, while ensuring careful treatment thereof, establishes a desired static position and orientation of products which are serially received at high speed and in close proximity to one another. In the implementation of this novel method, the invention also encompasses apparatus characterized by means for first accelerating and then decelerating the incoming products. The acceleration establishes a minimum predetermined spacial separation between a product being operated upon by the apparatus and the next succeeding product while the deceleration ensures that the thus separated product is stopped at a stacking or distribution point without a potentially damaging impact on a stop or other alignment member. In apparatus in accordance with the invention, the means which acquires products being received on the conveyor, and causes acceleration of such products, imparts a rotational force to the products. In accordance with the disclosed embodiments of the invention, the means which decelerates the products, such deceleration occuring after acceleration thereof has created the desired separation between the product and the next in-coming product in the product stream, also imparts a rotational force to the products. In accordance with one embodiment of the invention, a single pair of cooperating rollers may be employed to both accelerate and decelerate the products while, in accordance with a second embodiment of the invention, different pairs of rollers perform the acceleration and deceleration functions.

BRIEF DESCRIPTION OF THE DRAWINGS

The present invention may be better understood and its numerous objects and advantages will become apparent to those skilled in the art by reference to the accompanying drawings wherein like reference numerals refer to like elements in the two figures and in which.

DESCRIPTION OF THE DISCLOSED EMBODIMENTS

Figure 1:
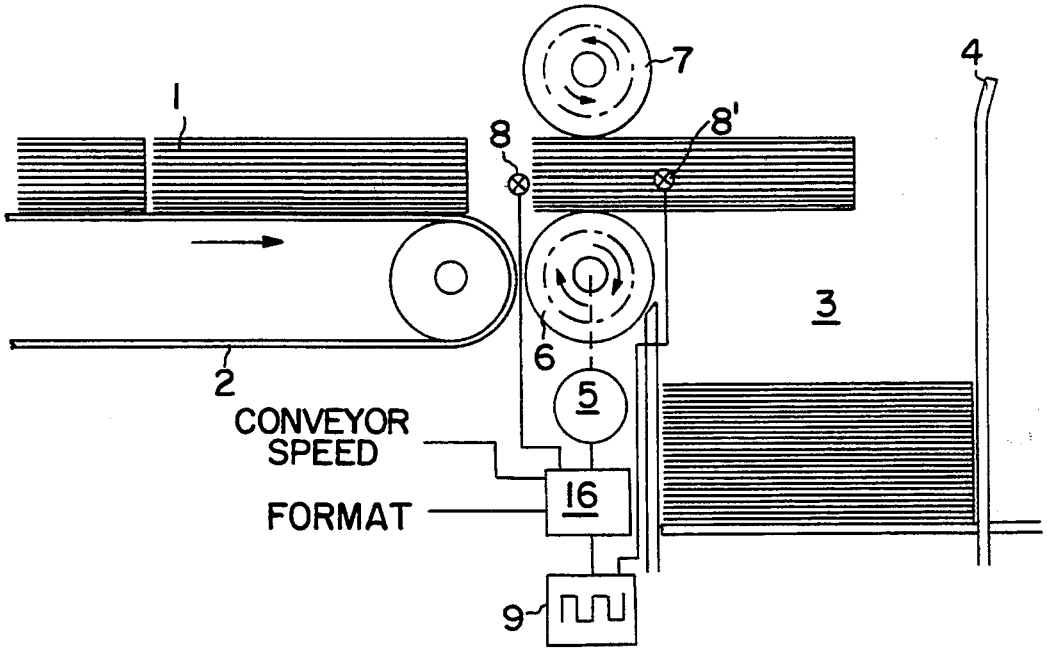
FIG. 1 is a schematic, side-elevation view of a first embodiment of a transfer device in accordance with the present invention.

With reference to FIG. 1, for purposes of illustration the products being processed have been indicated as stacks 1 of folded printed sheets which are exiting from a book-binding machine, not shown, capable of operation at a high production rate. The stacks 1 of sheets are delivered to a high-speed conveyor 2 in serial fashion and in a closely spaced relationship as shown. In the operating environment depicted in the drawings, the products 1 are to be deposited in a batch hopper 3 which is provided with a rear wall 4. Wall 4 functions as a combination stop and alignment member. However, as will be appreciated, any desired distribution mechanism, such as a turntable, elevator or the like may be substituted for the hopper 3.

A transfer device in accordance with the present invention is interposed between the conveyor 2 and the distribution point, i.e., the hopper 3. In the embodiment of FIG. 1, this transfer device comprises a cooperating pair of rollers 6, 7 which are located at the level of conveyor 2, i.e., the rollers define an extension of the path of product motion established by the conveyor. The spacing between rollers 6 and 7 is adjusted in accordance with the dimension of the product being processed such that the rollers will engage the product and cause it to move from conveyor 2 into vertical alignment with hopper 3. In the FIG. 1 embodiment, rollers 6 and 7 are driven synchronously by a variable speed drive motor or motors 5. At the time a product 1 is first acquired by rollers 6 and 7, the rotational speed of the rollers will be high compared to the speed of conveyor 2. Accordingly, the acquired product will be accelerated by rollers 6 and 7 thus creating a gap between the product 1 positioned between rollers 6 and 7 and the next succeeding product traveling on conveyor 2, i.e., a first incoming stack 1 will pull-away from the next incoming stack 1.

If the product 1 being processed is relatively fragile, the impact of the accelerated product against the stop 4 might cause damage thereto which would result in downstream quality control rejecting the finished product. Accordingly, at least a first sensor 8 is positioned along the path of the product movement. Sensor 8 may, for example, be a light barrier, i.e., a cooperating light source and light-responsive detector. When the trailing edge of a product 1 clears the sensor 8, the sensor will provide a control signal which causes a drive motor speed change command to be generated. This drive motor command signal will reduce the rotational speed of rollers 6 and 7 for the remaining time the product 1 is located between the rollers. This reduction in the speed of rollers 6 and 7 will decelerate the product 1 such that its forward motion is substantially arrested by the time the product 1 comes in contact with the stop 4. Accordingly, the product 1 will not rebound from stop 4 or be damaged by impact against stop 4 and the product will thus drop gently into hopper 3. As will be obvious to those skilled in the art, in order to achieve the above-described mode of operation, the positioning of the sensor 8 is important. This is particularly true when the product 1 being processed is a stack of folded printed sheets which could become skewed if permitted to deviate from the horizontal motion path. In order to prevent a stack from "tipping" downwardly when it passes over roller 6, the stack 1 must be conveyed to hopper 3 at a relatively high speed. Thus, the braking action may be applied to the stack only just before it reaches the stop 4, i.e., the retarding force is effective only in a region of short length located adjacent the trailing edge of the product.

As an alternative to the above-described arrangement of FIG. 1 wherein both of rollers 6 and 7 are syncronously driven, the invention may be practiced with a freely rotating, bearing-mounted counter-pressure roller 7. The use of such a freely rotating pressure roller at the upper side of the product will typically be used when the product being processed is inherently stable such as, for example, a book, a book block or individual printed sheets.

As yet another alternative to the embodiment of FIG. 1, the application of the braking force, i.e., the reduction in speed of the rollers 6, 7, can be commanded in response to measurement of the distance travelled by the accelerated product. Thus, a sensor 8' may be used to provide a signal commensurate with the length of time the product has been subjected to an acceleration force. An increment indicator 9, responsive to the signal from sensor 8', will provide a first input signal to a computer 16 which commands the initiation of the braking action at the appropriate time. The start of the braking cycle will also be dependent upon the product format and the speed of conveyor 2, the quantities also being provided as computer inputs.

Figure 2:
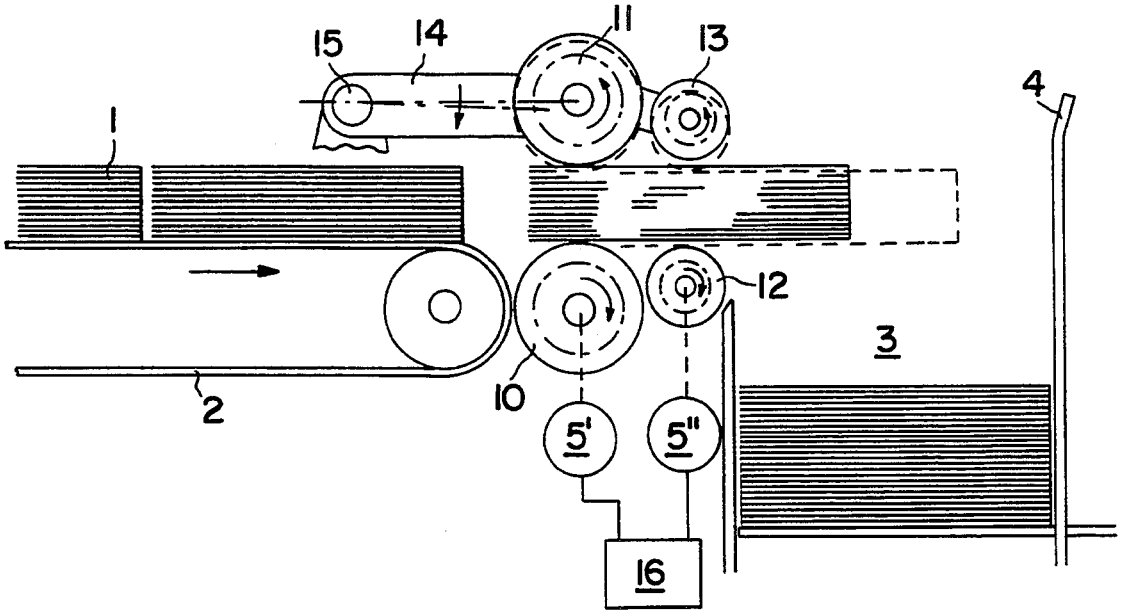
FIG. 2 is a view similar to FIG. 1 depicting a second embodiment of the present invention.

The embodiment of the invention depicted in FIG. 2 employs two pairs of rollers arranged one after the other in the direction of transport. The first pair of rollers 10, 11 acquire the product 1 and accelerate the thus acquired product between the braking rollers 12, 13 and toward the stop 4. The rollers 10, 11 are driven by a variable speed drive motor 5' at a rotational speed which is greater than that of the braking rollers 12, 13 which are driven by motor 5'' in order to achieve the requisite alternating acceleration/deceleration of the product 1. The outer diameter of the lower braking roller 12 is vertically disposed below the level of the transport path, i.e., below the outer diameter of the lower accelerating roller 10. Likewise, the outer diameter of braking roller 13 is, during acceleration of a product 1, disposed vertically above the outer diameter of accelerating roller 11. Rollers 11 and 13 are mounted on a carrier arm 14 which is free to pivot about axle 15. The portion of arm 14 extending between the axes Of rotation of rollers 11 and 13 is angled downwardly as shown. When the product 1 clears the accelerating rollers 10, 11, it will drop downwardly slightly into contact with the lower braking roller 12 as indicated in phantom on FIG. 2. Simultaneously, arm 14 will rotate clockwise thereby establishing contact between braking roller 13 and the product 1. This mode of operation permits the rollers 10, 11, and the rollers 12, 13 to be constantly driven at the appropriate speed, i.e., a speed change as discussed above in the embodiment of FIG. 1 is not required.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. Apparatus for individually transferring products to a distribution point, the products arriving at the transfer apparatus serially and in a closely spaced arrangement on a feed conveyor which defines a transport path, said transfer apparatus comprising:

means positioned adjacent the end of the feed conveyor for acquiring the products singly and accelerating each acquired product to thereby increase the spacing between the acquired product and the next succeeding product on the feed conveyor, said acquiring and accelerating means being rotationally driven, said means for acquiring comprising a first pair of vertically spaced rollers, the product exiting from the feed conveyor passing between and being engaged by the rollers of said first pair on an extension of the transport path, at least one of said rollers of said first pair being driven at a first speed which is greater than the speed of the feed conveyor, said first pair of rollers contacting the acquired product at the level of the feed conveyor; and means for decelerating the acquired single product subsequent to the creation of a desired minimum spacing between the acquired product and the next succeeding product, the forward speed of the acquired product being reduced by said decelerating means such that said forward motion may be arrested at the distribution point without damage to the product, said decelerating means comprising a second pair of vertically spaced rollers, the rollers of said second pair being arranged immediately downstream of the rollers of said first pair in the direction of product movement, at least a first roller of said second pair of rollers being driven at a speed which is less than the speed of the driven roller of said first pair of rollers, said second pair of rollers contacting only a portion of the product adjacent the trailing end thereof after contact between the product and said first pair of rollers has been discontinued.

2. The apparatus of claim 1 wherein the rollers of said second pair of rollers engage the product at a level which is offset below the transport path.

3. The apparatus of claim 1 wherein first rollers of each of said first and second pairs of rollers are mounted on a common carrier arm, said carrier arm being pivotal about an axis which is oriented transversely with respect to the direction of product movement.

4. The apparatus of claim 3 wherein the first roller of said second pair of rollers is supported from said carrier arm adjacent a first end of said arm and the first roller of said first pair of rollers is supported from said carrier arm intermediate said first roller of said second pair of rollers and said pivot axis.

5. The apparatus of claim 4 wherein said rollers of said first pair contact an acquired product at the level of the feed conveyor and the rollers of said second pair contact only a portion of the product adjacent the trailing end thereof after contact between the product and the rollers of said first pair has been discontinued.

6. The apparatus of claim 5 wherein the rollers of said second pair of rollers engage the product at a level which is offset below the transport path.

7. The apparatus of claim 6 wherein said first roller of said first pair of rollers has a greater diameter than said first roller of said second pair of rollers and said first roller of said second pair of rollers is displaced above a product contacted by said first roller of said first pair of rollers, said carrier arm pivoting to establish contact between said first roller of said second pair of rollers and the product when contact between said first roller of said first pair of rollers and said product is terminated due to forward motion of said product.

8. Apparatus for individually transferring products to a distribution point, the products arriving at the transfer apparatus serially and in a closely spaced arrangement on a feed conveyor which defines a transport path, said transfer apparatus comprising:

means positioned adjacent the end of the feed conveyor for acquiring the products singly and accelerating each acquired product to thereby increase the spacing between the acquired product and the next succeeding product on the feed conveyor, said acquiring and accelerating means being rotationally driven, said means for acquiring and accelerating comprising a pair of oppositely disposed rollers which define an extension of the transport path, products leaving the feed conveyor passing between said rollers, at least one of said rollers being driven by drive motor means, and means for decelerating an acquired product subsequent to the creation of a desired minimum spacing between the said product and the next succeeding product, the forward speed of the product being reduced by said decelerating means such that said forward motion may be arrested at the distribution point without damage to the product, said decelerating means comprising means for reducing the rotational speed of said drive motor means whereby said rollers are caused to rotate alternately at first and second speeds, said first speed being greater than the conveyor speed and said second speed being less than said first speed.

9. The apparatus of claim 8 further comprising:

sensor means for providing a control signal for causing the speed of said drive motor means to be reduced from said first speed to said second speed.

10. The apparatus of claim 9 wherein sensor means includes means for detecting the passage of the trailing end of an acquired product.

11. The apparatus of claim 9 wherein said sensor means includes means for providing a signal commensurate with the length of time the product has been subjected to acceleration.

12. The apparatus of claim 11 wherein sensor means further includes means responsive to said sensor means signal and to information corresponding to product size and feed conveyor speed for generating a control signal for said drive motor means.

13. The apparatus of claim 8 wherein both of said rollers of said pair are synchronously driven.

14. The apparatus of claim 8 wherein the upper roller of said pair of rollers is mounted for free rotation and the lower roller of said pair of rollers is driven by said drive motor means.

15. A method for the transfer of products comprising printed matter between a high speed feed conveyor and a distribution point, the products having a generally rectangular shape and being closely spaced on the feed conveyor, said method comprising the steps of:

engaging individual products which arrive at the end of the feed conveyor and imparing acceleration thereto in the direction of product travel established by the feed conveyor to thereby create a predetermined minimum spacing between successive products traveling on the feed conveyor, the product being accelerated by applying a rotational force thereto in the direction of travel established by the feed conveyor; and applying a deceleration force to the product subsequent to acceleration to thereby ensure that motion of the product is arrested at the distribution point, the product being decelerated by applying a retarding rotational forge to the product only in the region thereof which is located adjacent the trailing edge of the product, the retarding force operating in the same direction as the accelerating force.

16. The method of claim 15 wherein said accelerating force is applied over the full length of the product.

17. The method of claim 16 wherein said retarding force is applied at a point along the path of travel which is located downstream of the point of application of the accelerating force.

* * * * *